United States Patent [19]

Weintraub

[11] Patent Number: 4,461,156

[45] Date of Patent: Jul. 24, 1984

[54] SYSTEM FOR CONDITIONING AN AREA

[76] Inventor: Morton Weintraub, 942 E. 10th St., Brooklyn, N.Y. 11230

[21] Appl. No.: 324,405

[22] Filed: Nov. 30, 1981

Related U.S. Application Data

[63] Continuation-in-part of Ser. No. 098,364, Nov. 28, 1978, abandoned.

[51] Int. Cl.[3] ..... F25B 45/00; F25B 41/04

[52] U.S. Cl. ..... 62/149; 62/205

[58] Field of Search ..... 62/204, 205, 210, 211, 62/212, 222, 223, 224, 225, 510, 161, 511, 149, 174; 335/42, 18, 145; 337/350

[56] References Cited

U.S. PATENT DOCUMENTS

| | | | |
|---|---|---|---|
| 1,691,735 | 11/1928 | Oberschmidt | 335/145 X |
| 1,693,357 | 11/1928 | Vassar | 62/161 X |
| 2,260,682 | 10/1941 | Robson | 62/212 |
| 2,739,450 | 3/1956 | Breck | 62/196.1 X |
| 3,193,198 | 7/1965 | Carlson | 335/145 |
| 3,386,262 | 6/1968 | Hackbart et al. | 62/510 |
| 3,499,297 | 3/1970 | Ruff et al. | 62/160 |
| 4,270,361 | 6/1981 | La Barge | 62/211 |

*Primary Examiner*—Albert J. Makay
*Assistant Examiner*—Harry Tanner

[57] ABSTRACT

The present application relates to the means and method for controlling of refrigerant pressure of a refrigeration circuit and for controlling current input to a compressor of one or more refrigeration circuits in an inverse proportional relationship to the point temperature of a temperature setting, thereby enabling the compressors of a plurality of refrigeration circuits connected to a power supply to be broken upon a predetermined current increase beyond the current being controlled in an inverse proportional relationship to the point temperature of a temperature setting; enabling the automatic resetting of the circuit to the power supply when the predetermined current increase had been alleviated; and enabling the compressor of one or more refrigeration circuits to be maintained running after the temperature of an area being conditioned by the compressor of one or more refrigeration circuits becomes equal to the temperature of a temperature setting.

30 Claims, 20 Drawing Figures

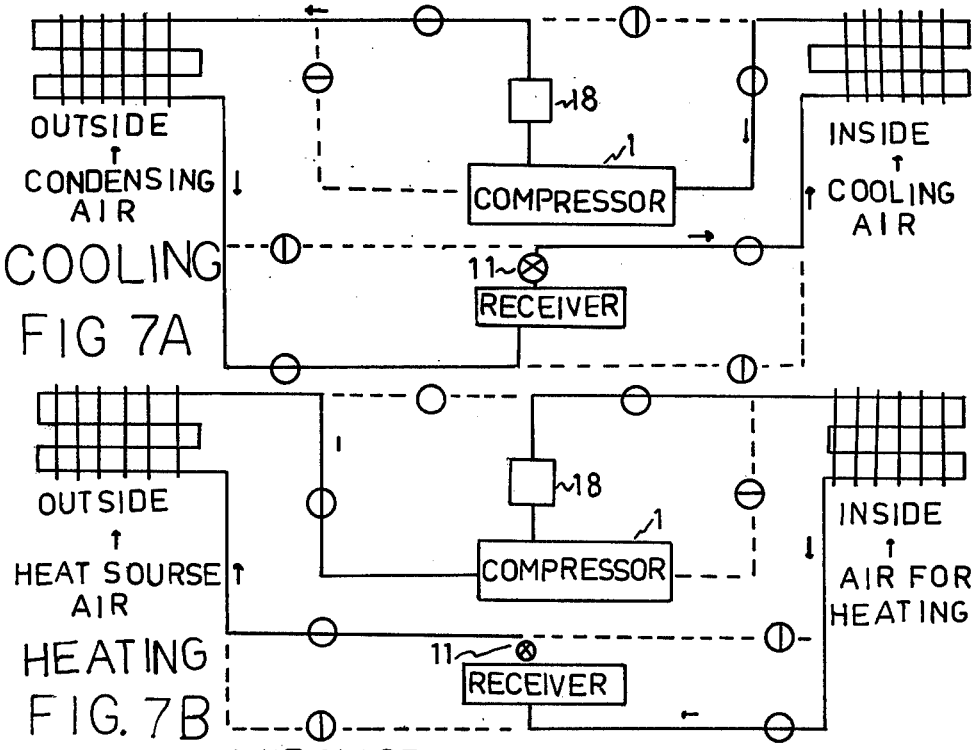
COOLING
FIG 7A
HEATING
FIG. 7B
VALVE CLOSED VALVE OPEN
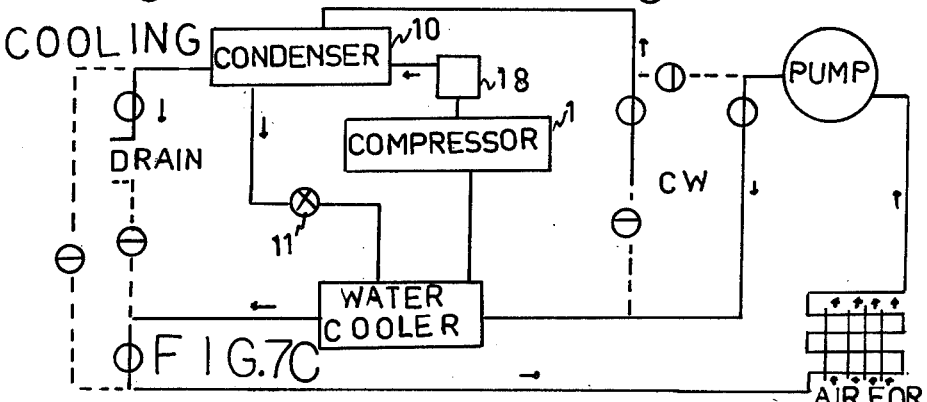
FIG.7C
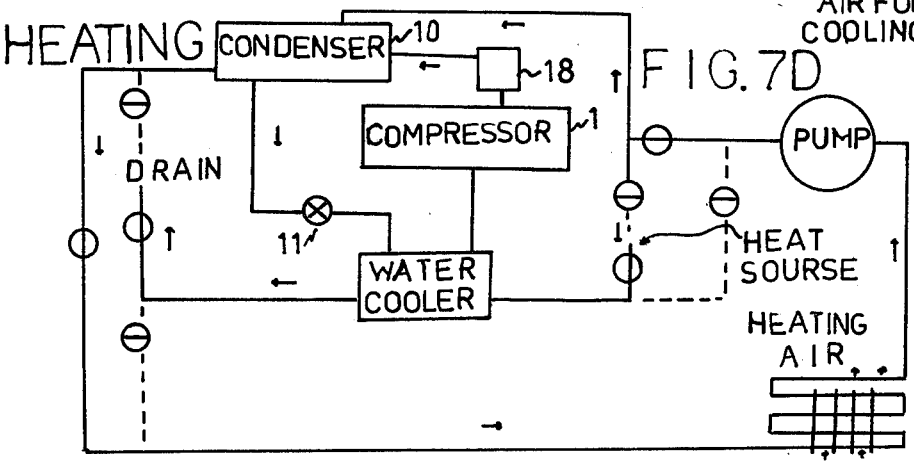
FIG.7D

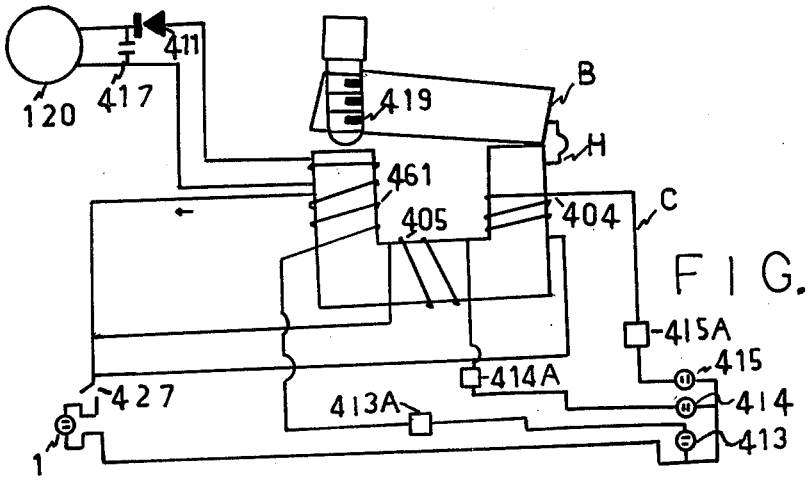
FIG. 8
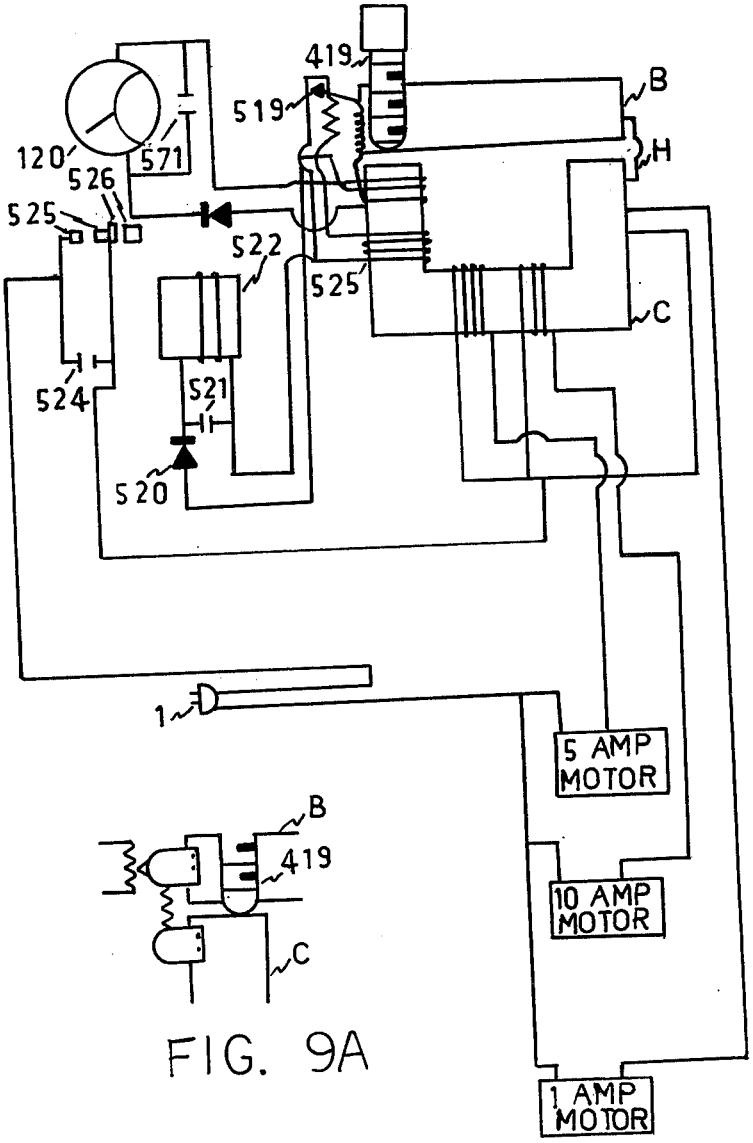
FIG. 9
FIG. 9A

SYSTEM FOR CONDITIONING AN AREA

This is a continuation in part of application Ser. No. 098,364, filed Nov. 28, 1979, now abandoned.

A first objective of the invention is to provide a means and method of manually and automatically controlling a variable chamber thereby controlling refrigerant pressure of a refrigeration circuit in an inverse proportional relationship to a point temperature of a temperature setting.

Another objective of the invention is to provide a means and method of manually and automatically controlling the current input to a compressor of one or more refrigeration circuits in an inverse proportional relationship to a point temperature of a temperature setting, thereby enabling the compressor of a plurality of refrigeration circuits to be controlled by a single circuit breaker.

Another objective of the invention is to enable the circuit connecting the compressor of one or more refrigeration circuits to a power supply to be broken upon a predetermined current increase beyond the current being controlled in an inverse proportional relationship to the point temperature of a temperature setting and enabling the automatic resetting to the power supply when the predetermined current increase had been alleviated.

Another objective of the invention is to enable the compressor of one or more refrigeration circuits to be maintained running after the temperature of an area being conditioned by the compressor of one or more refrigeration circuits becomes equal to the temperature of a temperature setting.

Another objective of this invention is to provide the means (in FIG. 6) for controlling the supply volume of heated or cooled air to a given area by controlling a chamber cavity and/or orifice manually and automatically (via gear 919 being geared to gear 310 for manual control and gear 303 for automatic control thereby controlling refrigerant pressure, current and/or supply volume requirements in a proportional relationship to a conditioned area.

BRIEF DESCRIPTION OF THE DRAWINGS

FIG. 7A is a drawing of an air-to-air heat-pump system hooked up for cooling effect, temperature control by one of the FIGS. 1–6.

FIG. 7B is a drawing of an air-to-air heat-pump system hooked up for heating effect, temperature control by one of the FIGS. 1–6.

FIG. 7C is a drawing of a water-to-water heat-pump system hooked up for cooling effect, temperature control by one of the FIGS. 1–6.

FIG. 7D is a drawing of a water-to-water heat-pump system hooked up for heating effect, temperature control by one of the FIGS. 1–6.

FIG. 8 is a drawing of a current control device which optionally may be connected and operating in FIG. 6.

FIG. 9 is a drawing of circuit breaking means and controlling current overload to the compressor motor.

FIG. 11 is a drawing of the piston type thermostat controlling a closed heating circuit.

DETAILED DESCRIPTION OF THE DRAWINGS

Among the underlying principles of operation of the innovative apparatus is as follows: When operating in an air conditioning unit, the controls will permit the unit to make use of a fraction of its peak power e.g. 7,000 B.T.U. in relation to 10,000 B.T.U. at peak output. The unit remains continuously "on" while maintaining the desired temperature (enabling a window to be left open as the unit will not shut down upon a temperature deviation). The object of the innovative method is to reduce the pressure upon the compressor by drawing off some of the Freon gas (or other cooling means) hence providing less cooling thereby providing less electrical surge.

There is a direct relationship between the B.T.U. output of an air conditioning unit and the unit's amperage, PSI (pounds per square inch) and temperature degrees obtained for a given room size. For illustration, the table below will shows the operating relationship of the innovative method and apparatus:

| AMPS | PSI | BTU | DEGREES |
|---|---|---|---|
| 15 | 25 | 10,000 | 40 |
| 12 | 20 | 9,000 | 50 |
| 9 | 15 | 8,000 | 60 |
| 6 | 10 | 7,000 | 70 |

We may therefore say that the object of the present method of temperature control is to control temperature by adding or subtracting pressure.

Figure 1:
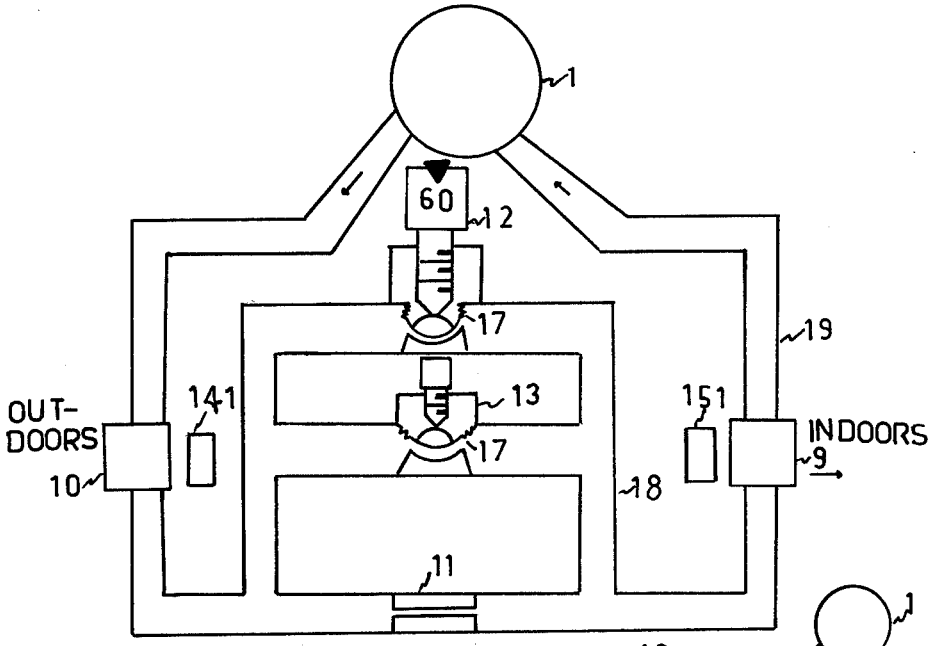
FIG. 1 is a drawing describing the operations of a manually operated thermostat operating in an air conditioning unit.

FIG. 1 is a drawing of a manually operated thermostat. The thermostat is situated between the evaporator and the condensor so as to allow more or less gas to pass. In operation the user sets the temperature by manually turning gauge 12 to the desired degree level. This action causes a contraction or expansion of expandable metal strip 17, allowing more or less gas to pass from the compressor. This operation should be viewed as follows: In an ordinary air conditioner, a compressor compresses gas which gets hot as a result of compression. The gas is then cooled via a cooling radiator and condensed via a condenser.

In the operation of the faucet thermostat, more or less gas is allowed to the condenser. Hence when the faucet is fully opened the condenser has little or no effect on the gas because the pressure on the gas is reduced. As the faucet (or piston, described in FIGS. 1A, 3) closes the gap in pipe or chamber 18, pressure on the gas is built up proportionately thereby. Cooling likewise results in a relationship to the opening and closing of the faucet.

The amount of cooling of a given room area in relationship to a given air conditioner may be calibrated so that a given opening of the faucet will result in a 70 degree temperature and whereas a given amount of turns of faucet 12 would normally result in the addition or subtraction of a degree based upon a given temperature outside.

For example, a 10,000 BTU system might cool a 1000 cubic foot area at full cooling capacity i.e. with the gap of the faucet fully closed, keeping the room temperature at a constant 50 degrees when the temperature outside is 90 degrees. Setting the dial of faucet thermostat 12 determines the temperature in the room. Note that by adding additional faucets we may have a finer control of larger units when they are used to cool a smaller area. Hence when a 10,000 B.T.U. air conditioning unit at full capacity is placed in a room of 500 cubic feet a setting of 50 degrees may be enabled by reducing the unit's cooling capacity by opening the gap of the additional faucets. The use of additional faucets would enable finer control of temperature in relationship to the outside temperature. For example, when the outside temperature is 80 degrees and the user desires 70 degrees inside, one may set one faucet theremostat to 80 degrees and another to 70 degrees. Both faucets would be calibrated to provide the desired temperature. In this connection, screw 13 serves as a second faucet for finer adjustment on a single unit. The compressor 1, evaporator 9, condenser 10, and expansion valve 11 are shown in FIG. 1. The fan of the condenser 141 blows outdoor air over the condenser coils, and evaporator fan 151 and coils 19 basically complete the refrigeration system. Note that one or more faucet or piston type thermostats may be used on the same unit in conjunction with each other or separately.

Figure 1A:
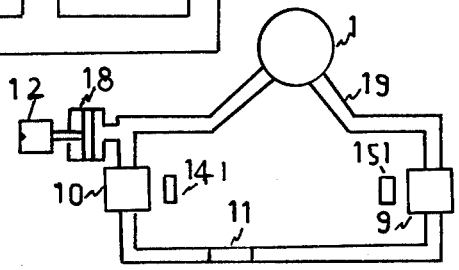
FIG. 1A is a "piston" type thermostat operating in an air conditioning unit.

Note that a stopper may be used instead of expandable metal strip 17 in FIG. 1 whereby the piston shown in FIG. 1A forces a stopper which serves to stop the air flow in duct 19 against spring means or open same depending upon which way 12 is turned, causing thereby a calibrated temperature reading upon 12 as shown in FIG. 1. Such a thermostat may be labeled a piston type thermostat. Another variation of the piston type thermostat is described in FIGS. 3, 1A.

FIG. 1A is similar in operation to that of FIG. 1. However, FIG. 1A discribes the operations of the piston type thermostat. The freon gas is compressed by compressor 1 and passes coils or tubes whereby more or less gas may circulate to compressor 1 as a result of the action of the piston and its chamber 18 when more gas enters the chamber a higher temperature will show on gauge 12 and also on the room thermometer; and vice versa with less gas drawn by piston and its chamber 18.

Figures 3, 3A:
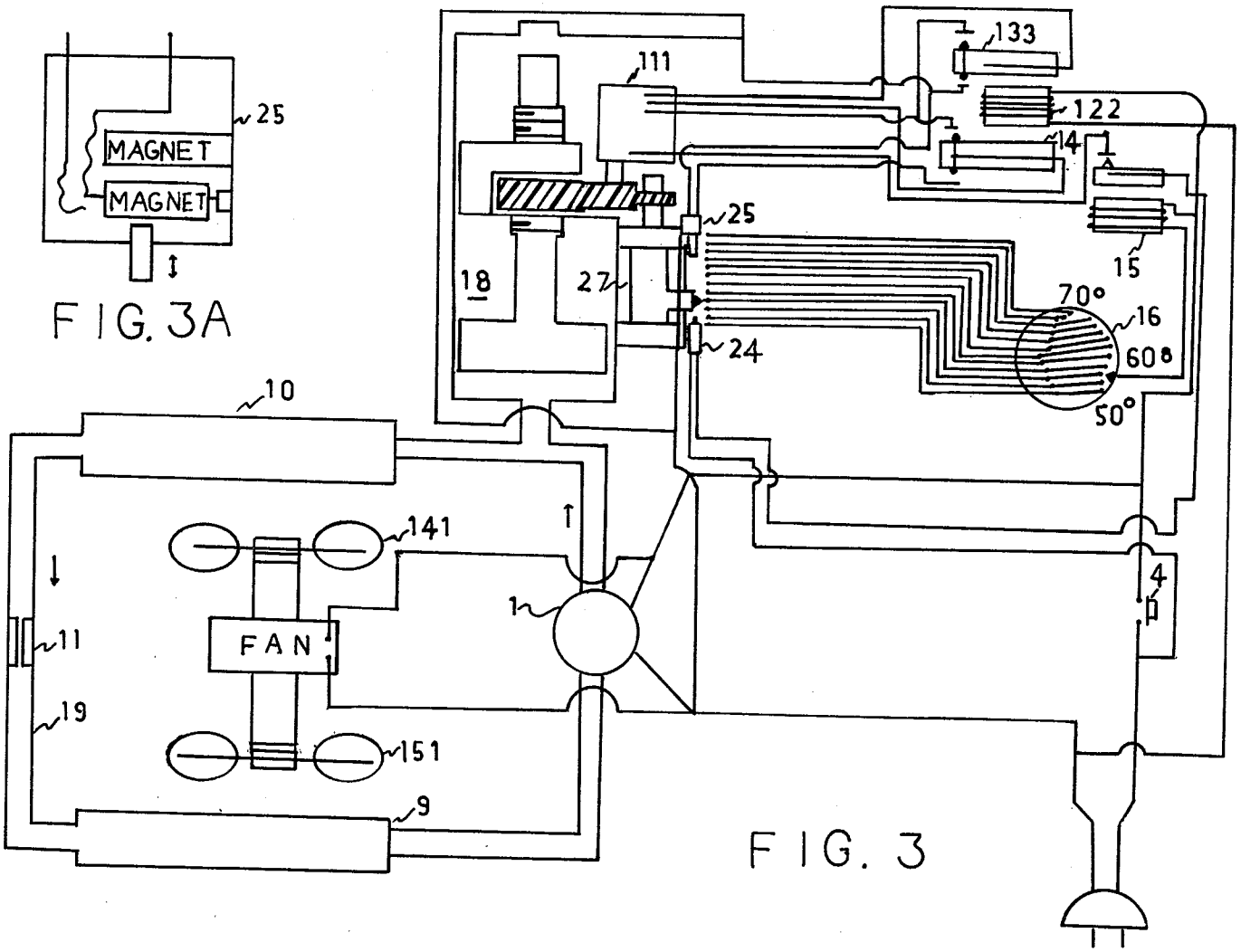
FIG. 3 is another type of motorized control of FIG. 1A.

Note that both the piston and faucet types of thermostats may operate in conjunction, whereby, a piston type thermostat may be installed in FIG. 1 between the condenser 10 and the compressor 1 attached to pipe 19 as part of the system. The use of the faucet thermostat may be extended to be operated automatically via a motorized control of the gap opening. FIG. 3 is a drawing of the operation of a motorized piston (a faucet type shown in FIG. 1 may used as well) thermostat. The plug is plugged into an AC outlet and switch 4 puts the air conditioning unit on. The "on" position causes relay 122 to become energized thereby pulling inwards contacts 133 and 14 against a spring action keeping same apart, thereby causing a clockwise (downwards) spin on piston 18. When contacts 133 and 14 are released a counter clockwise movement (upwards spin) results.

The user sets thermostat 16 manually even at a remote location from the air conditioning unit, whereby the thermostat is hooked to the piston controls. The wires on thermostat 16 represent degree settings. Each wire represents two degrees. Time delay switches 24 and 25 operate in a manner whereby when block 27 depresses switches 24 and 25 they will turn off motor 111 after a time delay. When piston 18 is fully up, activating switch 4 causes a downward movement of piston 18 thus causing a corresponding downward movement of block 27 until its pointer comes into contact with the same wire setting, manually set on thermostat 16. The circuit being completed via relay 15 will stop motor 111 haulting piston 18. Note that the compressor and fan still continue in operation. When "on" and "off" switch 4 is switched to the off position piston 18 will move upwards to the top of its chamber releasing the pressure from the unit, as activation of the reverse winding of motor 111 is caused thereby. When block 27 hits switch 25 it will cause a shut down of the unit, while activating switch 24 will reverse the motor thereby bringing piston 18 back up.

FIG. 3A illustrates the action of switch 25 (and switch 24).

Note that the arms of relays 15 and 122 are kept open by spring action until they are activated by the relay. Note that there are numerous other ways in which motor 111 may be controlled as a result of a manual temperature setting. For example, a higher manual setting may cause motor 111 to spin whereby it tightens or loosens a rope. A higher manual temperature setting will result in a spin on motor 111 resulting in a tightening of the rope causing piston 18 to go upwards.

Figure 2:
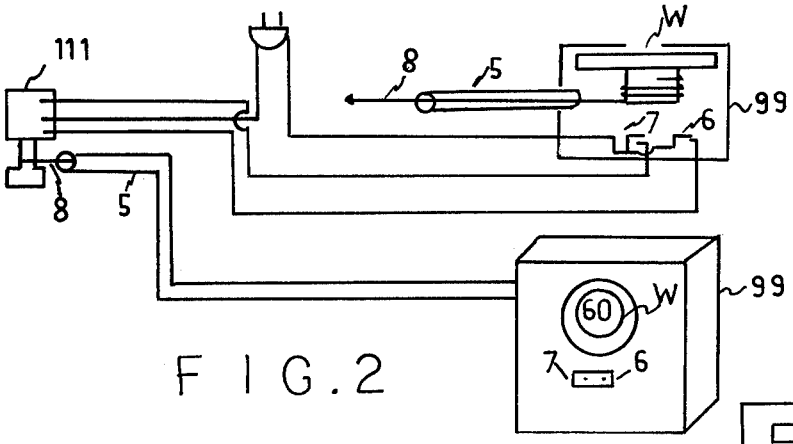
FIG. 2 is a drawing describing the operations of a motorized thermostat control of FIGS. 1, 1A.
Figure 2A:
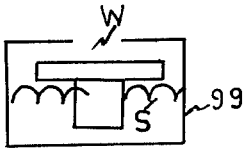
FIG. 2A describes the spring action against the rope of the meter and attached to the meter wall.

FIG. 2 is a drawing of this kind of thermostat. Rope 8 in its encasement 5 operates similarly to the operation of the hand brake of a bicycle. Temperature is set on thermostat 99 by manually depressing bell type switch 6 (for a higher setting at window W, causing motor 111 to spin piston 18 (see FIG. 3) upwards) and switch 7 (for lower setting causing a reverse action on motor 111). Note that a spring S (see FIG. 2A) maintains a pulling action against the rope 8 keeping the the degrees shown at window W at 60 unless electronically put to a higher level as a result of activating switch 6 or to a lower level by activating switch 7.

Motor 111 is geared to piston 18 (see FIG. 3) and thermostat 99 is so calibrated so as to provide the cooling from the air conditioning unit to the degree setting upon the thermostat.

Figure 6:
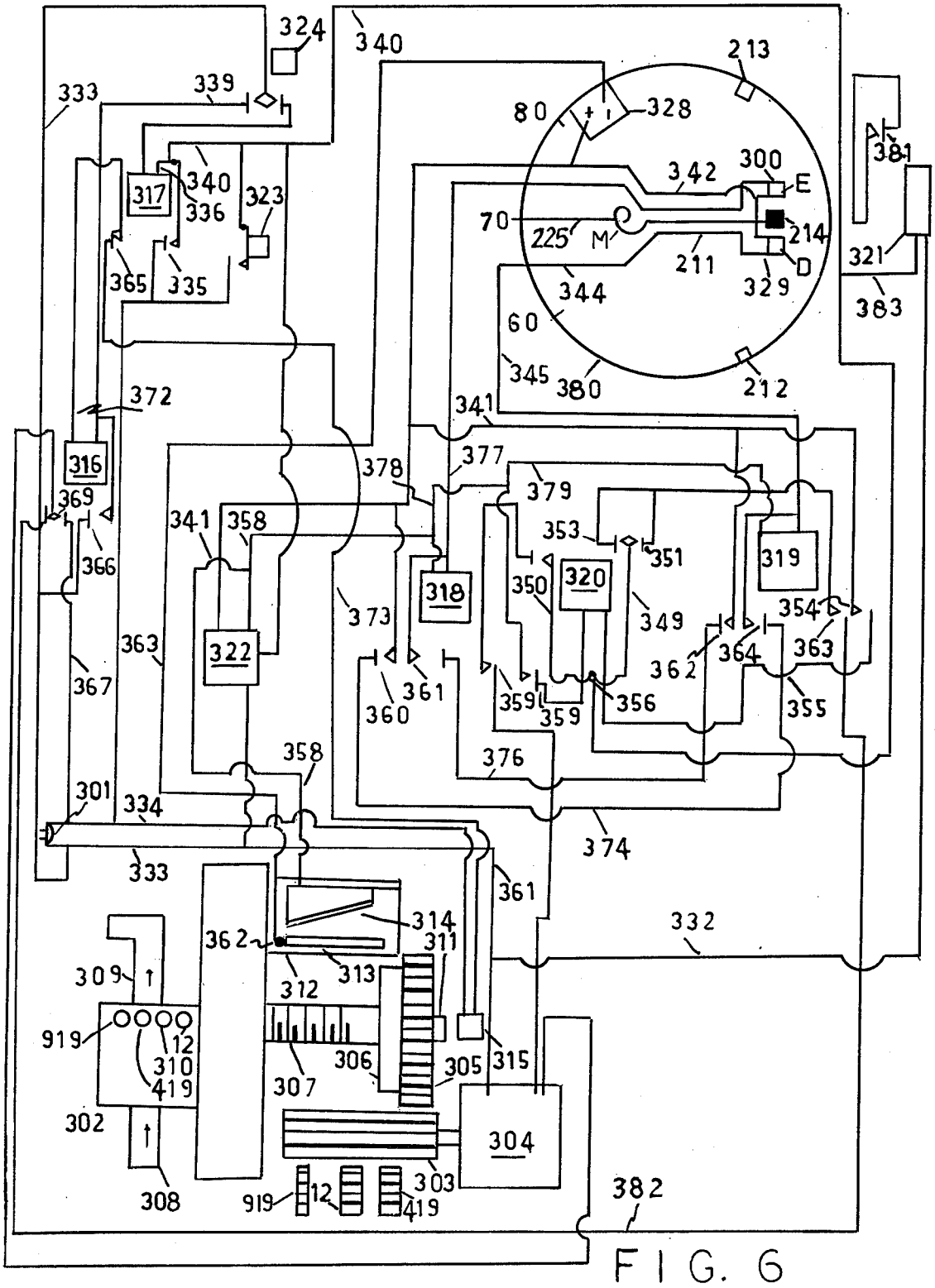
FIG. 6 is a drawing of the circuitry of FIG. 5.

FIG. 3 is a drawing of the operation of a motorized control of FIGS. 1, 1A and is included in FIG. 6 at the option of the user by controlling 310 (the functional equivalent of 12 having a gear thereon (not shown) in FIGS. 1, 1A). Note that while FIG. 3 illustrates the drawing off operation of the piston as shown in FIG. 1A piston 18 of FIG. 3 may be substituted by expanding and contracting means 17 and providing the operation of mixing high and low pressure refrigerant as shown in FIG. 1.

The plug in FIG. 3 is plugged into an AC outlet and switch 4 puts the unit on. The "on" position causes relay 122 to pull contacts 133 and 14 against spring action (not shown) causing thereby a downwards spin on the piston mounted in chamber 18. When said contacts are released an upward movement of said piston results.

The user may set a selected temperature on meter 16 which may be at a remote location. The temperature setting means thereby is connected to wires as shown. Time delay switch 24 operates whereby when block 27 depresses said switch it acts to turn off motor 111 after a time delay. Switch 24 when activated causes piston to move upwards to switch 25 and activating same. When said selected temperature has been set, contact of block 27 adjusting the cavity of chamber 18 by activating relay 15 causes motor 111 to stop. When switch 4 is in the "off" position motor 111 brings the piston all the way up until block 27 engages switch 25. Chamber 18 is identical to that in FIG. 1 and is calibrated to provide the operations of Table 1. FIG. 3A illustrates the action of switches 24,25. In FIG. 3 the arms of relays 15,122 are kept open by a spring (not shown) until said relays are activated forcing their closing.

FIG. 2 is a drawing wherein motor 111 controls the size of the cavity and/or orifice of chamber 18 as disclosed in the disclosure of FIGS. 1, 1A. Motor 111 of FIG. 2 may be geared to 12 in FIGS. 1, 1A or to 310, the functional equivalent of 12 in FIG. 6, such that 12 or 310 have gearing means (not shown) and said means are geared to motor 111 of FIG. 2 and controlled by the apparatus of FIG. 2. A higher temperature setting, set manually by manually depressing switch 6, causes motor 111 to control 12 in FIGS. 1, 1A or 310 in FIG. 6 thereby increasing the pressure requirement of the refrigeration circuit thereby lowering the temperature of the area being conditioned, whereas depressing switch 7 achieves an opposite effect. Spring S (see FIG. 2A) maintains a pulling action on rope 8. Rope 8 being encased in 5 as shown. When motor 111 of FIG. 2 controls 310 of FIG. 6 whereby the operation is as disclosed of FIG. 2, it provides the means to manually increase or decrease the actual temperature of an area being conditioned, such that said manual control is effected with or without the cooperation of the automatic operations disclosed in FIG. 6.

Figure 4:
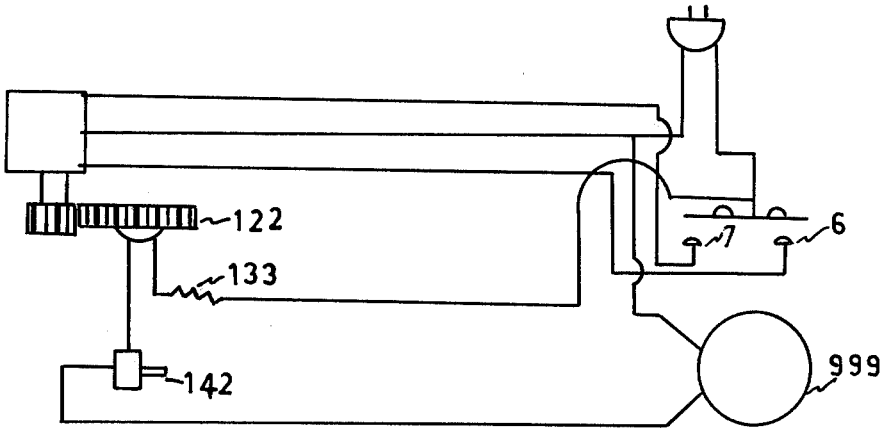
FIG. 4 is a drawing describing the operations of another electronic motorized thermostat control of FIGS. 1, 1A.

FIG. 4 represents a thermostat also operated electronically. AC meter 999 is calibrated in temperature degrees. Bell type switches 6 and 7 described previously are connected to the forward and reverse winding of motor 111. Meter 999 is connected to resistor 133 which serves to knock out current from meter 999 so that it may be set by rheostat 122. Rheostat 122 opens or shuts the current to meter 999, hence gauging the needle reading on meter 999 to a desired degree setting. Adjusting rheostat 122 serves to manually adjust meter 999 to the desired degree setting.

In operation, when button 6 is depressed, this causes a forward spin on motor 111 turning rheostat 122 into a position whereby there is a desired temperature reading on meter 999. Motor 111 will stop when button 6 is released. Motor 111 controlls the level of piston 18 and 17 in FIG. 1A whereby the gear of motor 111 is geared to rheostat 122 and to the piston in FIG. 1A via gear 12.

Figure 5:
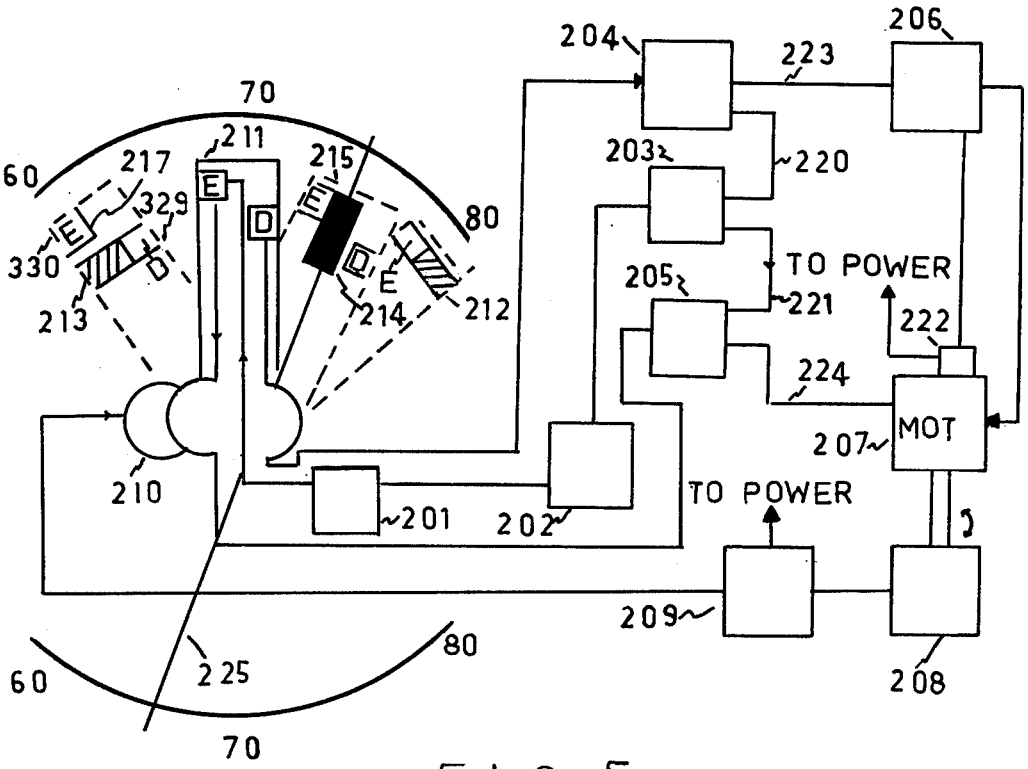
FIG. 5 is a drawing in block form of a motorized automatic adjusting thermostat control, adjusting the unit's output continuously to maintain the desired set temperature.

FIG. 5 is a block diagram describing the automatic thermostat operations controlling the movement of the faucet or piston described previously.

Power supply 201 when the "on" relay 202 is energized will feed current to relay 203. Current is then passed to wire 220 and 221. Relay 204, controls the up drive coil of motor 207 driving the piston 208 (see 305 FIG. 6) up. Relay 205 controls the down coil of motor 207 driving piston 18 downwards, with current stemming from wire 221. When Relay 203 is energized, it causes current to flow through wire 220 only, not through wire 221. Relay 206 is the "off" relay causing motor 207 to cause an upward spin on the piston represented in block 208, and then to close the power by closing switch 222 and at the same time disconnect current from wire 223.

When motor 207 turns clockwise it causes piston 208 to close while turning counter clockwise it will open piston (or faucet see FIG. 1) 208. When piston 208 goes downward it increases current flow via volume control 209, while reducing current flow when piston 208 goes upward. Said increases or decreases in current flow is reflected by meter 210, and causing scanner 211 to move to the right with an increase in current; to the left with a decrease in current.

With no current to the unit scanner 211 will be at position 217. Scanner 211 starts to scan toward the right with an increase in current, at the same time the down drive of motor 207 is activated. When the scanner magnetic switch D is over permanent magnet 214 it will energize the up relay 204, disconnecting current from wire 223. At this time magnetic switch E is out of the magnetic influence of permanent magnet 214, thereby not energizing the down relay 205.

The movement of scanner 211 continues to the right until reaching position 215 which is the "on target" position, as the scanner 211 will stop moving thereby stopping motor 207, piston 208, volume control 209, and meter 210. This comes about when magnetic switches D and E are equally under the influence of permanent magnet 214, whereby 204 and 205 are activated to cut current from wire 223, 224.

Temperature is measured by pointer of permanent magnet 214 as it is connected to an expanding and contracting spring (shown in FIG. 6) which expands and contracts as a reaction to temperature. By setting pointer 225 to any temperature desired, this will control the position of permanent magnet 214 as it is connected to pointer 225. Pointer 225 in our example is on 66 degrees while permanent magnet 214 is between 74 and 75 degrees. As explained previously, piston 208 works in an aircondtioner by increasing the amount of cooling via the down drive and reducing cooling via the up drive. When the temperature is high as in our example, 74 degrees, scanner 211 will cause piston 208 to close and scanner 211 will move until over permanent magnet 214 whereby it is on target closing magnetic switches stopping all movement. Movement starts again with a temperature change as permenant magnet 214 will move away from its present position. Should there be a one half degree change to 73½ magnetic switch D will be out of the influence of permenant magnet 214 thus causing relay 204 to become deactivated causing the activation of the up drive of 207, causing less current through volume control 209 and causing meter 210 to move scanner 211 to the left until on target over permenant magnet 214 at 73½ degrees. This cause and effect relationship will be repeated should the temperature go back to 74½ degrees. Similarly, when the temperature goes up to 75½ degrees thereby resulting in the movement of permenant magnet 214 away from magnetic switch E while magnetic switch D is still under the magnetic influence of permenant magnet 214, it will cause a deactivation of relay 205 whereby wire 221 is connected to wire 224 passing current to the down drive of motor 207 closing piston 208, causing scanner 211 to move to the right via the action of meter 210 until on target.

Relay 203 is for free scan. If for any reason scanner 211 was in position near 217, such as because of interruption of electricity, relay 203 would automatically activate the up drive of motor 207 causing a movement of scanner 211 to the left until magnetic switch D comes into influence of permanent magnet 213 to activate magnetic switch D and activating the down drive of motor 207, causing a movement to the right of scanner 211 until over the "on target" position whereby activating switches D and E. Similarly, the operation of permanent magnet 212 should scanner 211 pass all the way to the right for some reason, whereby magnetic switch E contacting 212 would be activated, reverses the movement of the scanner.

In the example given previously, there is a relationship between the 1000 cubic ft. room and a 20000 B.T.U. air conditioner operating at full capacity with piston 208 all the way down, or fully closed. At 90 degree temperature, if the air conditioner provides us with 60 degrees inside the room at full capacity operation, then to provide us with 70 degrees inside the room, piston 208 would close down about half way in affect giving us now a 10000 B.T.U. air conditioner; a 5,000 B.T.U. air conditioner for 75 degrees and so on.

In order to calibrate the thermostat, this system would be placed into a room with 70 degrees temperature whereby the pointer over permanent magnet 214 points to a corresponding temperature reading of 70 degrees and setting at the same time pointer 22 to 70 degrees. Hence, there are now two ways of controlling the amount of cooling: (1) via the temperature (magnet 214); (2) via pointer 225.

Now, with 90 degrees at start up of the unit magnet 214 would be over to the 80 degree mark, hence causing the unit to operate at full capacity of 20000 B.T.U. decreasing the B.T.U. output with lowering temperatures until 70 degrees set by pointer 225 is reached whereby the unit will be working at 10000 B.T.U. output or at half capacity, as illustrated above. Hence, whenever pointer 225 is in a straight line with pointer of permanent magnet 214 as shown in FIG. 5 the air conditioner will stabilize at that setting. Should pointer 225 be now set at 75, permanent magnet will automatically move towards 60 closing down piston 208. How much piston 208 will close depends upon the weather. Suppose the temperature is 72 degrees in the room as arm 225 is set at 70 then the pointer of the permanent magnet would set itself at 72 degrees and stop. If pointer 225 is set at 75, then the pointer of 214 will stop at 67 so that we have a straight line up, and stabilized operation.

If the temperature increases (past 90) or the door of the room is opened, this will automatically cause the unit to operate on a greater output as permanent magnet 214 will move toward 80. If the temperature decreases the permanent magnet will move toward 60 reducing the output of the unit in B.T.U. The same is the reaction when a large capacity unit would be placed into a small room or vice versa. The same applies for a refrigeration unit. When the door is kept closed the temperature therein is kept as set. When the door is opened cooling would automatically increase. FIG. 6 illustrates the circuitry of FIG. 5.

There are two power supplies: (1) 110 volts via plug 301; (2) a DC power supply 322 providing power to all DC relays and components.

Motor 304 will close piston 305 (enclosed in a chamber as shown in FIG. 3, not shown here) or open same. Screw 310 (see 11 in FIG. 1) is used for finer adjustment of the air flow as explained previously, Pipe 308 (as in FIG. 1) is for the incoming Freon gas while pipe 309 is for outgoing gas. When motor 304 rotates it rotates gear 303 and 305 causing screw 307 to move up or down.

Volume control 312 operates in a manner whereby a liquid or gas conductor such as water or neon increases or decreases current flow coming from negative wire 358 connected to plate 314 passing current to the liquid or gas conductor to magnetic bar 313 to hinge 362 and out on wire 363 connected to the hinge. When permanent magnet 306 fitted on to screw 307 goes downward it will push away permanent magnet 313 placed whereby they will repell each other, maintaining the same distance away from each other. When screw 307 goes down an increase of current will result flowing from permanent magnet 313 to plate 314 with movement closer to 314.

Relay 317 receives current from wire 333 via switch 324 which is normally in the up position. When switch 323 is pressed momentarily it will pass AC from wire 334 to wire 340 and to wire 336 energizing relay 317. Switch 335 will keep relay 317 energized constantly unless electricity in momentarally interrupted. Switch 335 will also pass AC to the unit via wire 340. Switch 365 disconnects "off" relay 316.

To shut the unit off, button 324 is pressed momentarily as it disconnects relay 317 (the "on" relay) at the same time connecting "off" relay 316. When relay 316 is energized it keeps itself energized via switch 366.

Alternating current to relay 316 stems from wire 333 which passes current through wire 339.

AC stems from wire 334 passing through switch 315 to wire 373 to switch 365 and to wire 372 energizing relay 316. Switch 369 has two functions: (1) when the unit on (meaning that relay 316 is off) then current from up relay 319 will pass through wire 368 and switch 369 to the up drive of the motor; (2) when the unit is shut off (meaning that relay 316 is now in operation) this will cause current to pass from wire 367 through switch 369. The purpose of this is to drive the motor so that the piston will move (going upwards). Note that when "off" relay 316 is in operation the rest of the unit has already been shut off via the pressing button 324.

Magnetic switch 315 will stop current going to "off" relay 316 when 305 is all the way up. This action is carried out by permanent magnet 311 mounted on top of 305 coming into contact with magnetic switch 315.

Relay 319 (the up relay) controls the up drive of motor 304. Motor 304 is energized only when the relay itself is not energized since when current is fed to relay 319 this stops current to motor 304.

Relay 318 (the down relay) controls the down drive of motor 304. When relay 318 is energized then motor 304 is de-energized while when relay 318 is de-energized it will cause motor 304 to rotate so as to close piston 305 downward.

Relay 320 causes motor 304 to spin 305 upwards if both relays 318 and 319 are de-energized. This action will prevent motor 304 from burning out in case of a malfunction or current interruption to relays 318 and 319 (as they would release their bars). Relay 320 serves therefore to connect to the up drive only.

Motor 304 gets current from (1) "shut off" relay 316; (2) relays 313–320. Current to the motor from relay 316 is explained as follows:

Current comes from switch 357. Current will pass only when relay 318 is de-energized thereby closing switch 357, hence passing negative current from negative wire 358 to wire 356 of relay 320. Note that only when both relays 318, 319 are deenergized will relay 320 operate.

When relay 320 is energized it will disconnect current from relay 318 by opening switch 350. Negative DC for relays 318, 319 is provided via wire 358 passing current to wire 378 of relay 318 to wire 379 of relay 319.

Describing now the operation of thermostat 380. Thermostat 380 is a combination of five parts: 3 magnets, 2 magnetic switches, 1 meter, 1 thermostatic metal.

Meter 328 is a heavy duty meter which has the capability of moving the scanner up and down on the face of thermostat 380. The movement across the face is accomplished by the volume control 210, which when there is an increase in current, will cause the meter 328 to move scanner 211 to the right towards magnet 212. When current decreases, it causes meter 328 to move the scanner to the left towards magnet 213. Magnetic switch 330 when closed will cause it to conduct electricity through it. This action will pass current from positive line 341 through 342 in turn passing positive current to positive wire 377 of relay 318, thus engaging relay 318. Note that once relay 318 is energized by switch 330 it will stay "on" even after the magnet is away from switch 330 because switch 361 keeps relay 318 locked in.

Magnetic switch 329 acts exactly as does magnetic switch 330 except that switch 329 activates relay 319 by passing current from wire 342 through switch 329 to wire 344, to wire 345, to wire 375 of the relay coil. Once relay 319 is triggered it will be kept energized by switch 364, and would only release its bar when relay 318 is energized.

Magnet 214 is the scan locker, meaning, this will stop the movement of scanner 211 from scanning. This is done by magnet 214 magnetically switching switches 329, 330 so that current will disconnect from motor 304 stopping movement of the piston and volume control 312 keeping current to meter 328 steady thus stopping scanner 211.

Magnet 212 is so positioned so that it will activate magnetic switch 329 only, thereby causing scanner 211 to move back to the left side.

Magnet 213 is so positioned that it will only activate magnetic switch 330 causing scanner 211 to go toward the right.

The purpose of magnet 213 is as follows: if for some reason scanner 211 passed permanent magnet 214 thus going toward magnet 213, then 213 would cause it to move back to permanent magnet 214. Normally however, scanner 211 would never pass permanent magnet 214 unless caused to by setting thermostat arm 225 to a different location or when there was an interruption of electricity, as explained previously. However magnet 214 is so constructed so that when it moves to either side it will keep the magnetic field under both magnetic switches equally balanced.

Pointer arm 225 enables the setting of different degrees. When 225 is moved, 214 moves along with it, hence giving the thermostat a new reading.

Expanding and contracting rod or metal M of the thermostat which expands or contracts with changes in temperature is mounted on thermostat arm 225 so that when arm 225 moves so will expanding rod to give thermostat a new reading.

Relay 321 would be employed in larger units requiring a contact relay (with high amperage contacts on switch 381 being able to handle a large compressor). Negative current comes from wire 332 which is connected to wire 361 from the motor which is connected to negative wire 333. Its positive wire 383 is connected to relay 317, hence, when relay 317 is activated contacts 381 close thereby starting the compressor. When relay 317 is deactivated, relay 321 is also. Note that relay 321 is not necessary on small units.

It should be noted that the automatic adjusting means adjusting the cavity of the chamber wherein the refrigerant is forced may also control simultaneously motor 207 in FIG. 5 geared to one other chamber similar to 208, but larger in size whereby the output of the cooling system or the output of the heating and cooling system may be channeled to the second chamber. The second chamber would be so calibrated so as to effect continuously and automatically a calibrated supply volume of heated or cooled air to at least one given area whereby the actual temperature of the given area equals that of the desired temperature setting. Of course the chamber may operate whereby the output of any such system is channeled to another chamber.

In order to coordinate the components in FIG. 6 with the blocks in FIG. 5 the following is a listing of both figures

| Parts in FIG. 6 | Block No. in FIG. 5 |
|---|---|
| Power supply (DC) 322 and AC line from plug 301 | 201 |
| "On" relay 317 and switch 323 | 202 |
| Relay 316, switch 324 | 206 |
| Switch 315 | 222 |
| Relay 319 | 204 |
| Relay 318 | 205 |
| Relay 320 | 203 |
| Motor 304, gear 303 | 207 |
| Piston (or faucet) 305, screw 307, permanent magnet 311, chamber 302, permanent magnet 306, adjusting screw 310 inlet pipe 308 outlet pipe 309 | 208 |
| Container 312, permanent magnet 313, plate 314, hinge 362 | 209 |
| Meter 328 | circle 210 |
| Scanner 211 | scanner 211 |
| Magnet 212 | permanent magnet 212 |
| Magnet 213 | permanent magnet 213 |
| Magnet 214 | permanent magnet 214 |

FIG. 6 is a drawing of the manual and automatic operations and circuitry of FIG. 5. Both FIGS. 5 and 6 disclose the operations of controlling the size of the cavity and/or orifice of chamber 18 in FIGS. 1, 1A thereby controlling the operations of controlling pressure, hence controlling temperature as disclosed in the disclosure of FIGS. 1, 1A and Table 1. Hence, FIGS. 5, 6 illustrate automatic control and manual control when 310, functionally identical to 12 in FIGS. 1 1A, is operated manually by hand as disclosed for 12 in FIGS. 1, 1A or as a function of user preference, having motor 111 of FIGS. 2–4 geared to 310 whereby said manual control is performed via motor 111. Hence the apparatus of FIG. 6 may be operated manually and/or automatically at the option of the user.

Figure 10:
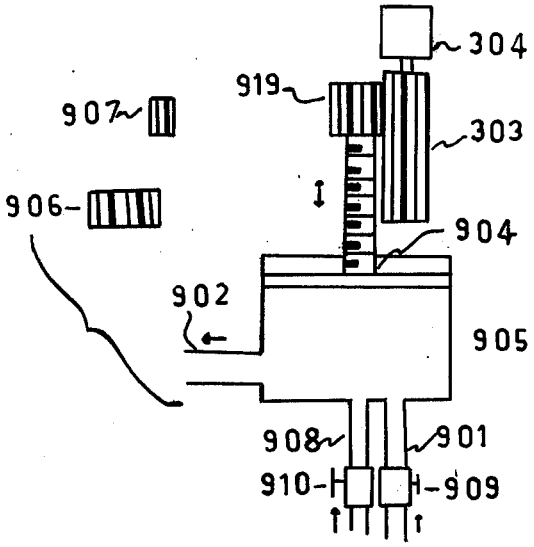
FIG. 10 is a drawing of the operation of a device controlling supply volume.

The apparatus disclosed in FIG. 6 may control at the user's option also current requirements to the compressor motor (when gear 419 of FIG. 8 is geared to gear 303 and when the compressor motor is connected to one of the outlets in FIG. 8); also controlling circuit breaking means which is reset automatically to a power supply upon stabilization of calibrated current (when gear 419 of FIG. 9 is geared to gear 303 of FIG. 6) such that FIG. 6 enables automatic control of current requirements of the refrigeration circuits disclosed in FIGS. 1, 1A in a relationship to pressure and in inverse proportional relationship to temperature as disclosed in Table 1. Manual control of FIGS. 8, 9 is provided when gear 419 of FIGS. 8, 9 is geared to 310 of FIG. 6 thereby providing manual and/or automatic control of the means disclosed in FIGS. 8, 9 as a function of user preference. Gear 919 of FIG. 10 is also geared to 303 and/or 310 thereby enabling the control of supply volume manually and/or automatically by the operations of FIG. 6.

In FIG. 6 there are two power supplies: (1) 110 volts via plug 301 (2) a DC power supply 322 providing power to all DC relays and components.

Motor 304 will turn gear 305 increasing pressure (and current requirements when gear 419 of FIGS. 8, 9 is geared to 303 increasing the size of the gap of core c). The operation of 305 and 307 is similar to the operation of 12 and 13 respectively in FIG. 1, whereby motor 304 controls 305 via 303 thereby controlling the refrigeration circuit of FIG. 1 via piston or the expanding and contracting means as shown in FIG. 1. The right and left side of chamber 18 are represented by 308 and 309 in FIG. 1 respectively.

FIG. 7 shows how a piston (or faucet) type thermostat is applied for heating as well as cooling in heat pump systems. Note that block 18 is designated to represent the piston which may be controlled manually or automatically as shown in FIGS. 1–7. Piston 18 is insulated.

FIG. 7A represents an air to air heat pump system for providing also a cooling effect therefore providing the operation as a refrigeration mechanism in which heat at temperatures too high for use for cooling is extracted in the evaporator (9) (inside surface pumped by the refrigeration mechanism to a condensing medium (outside surface) (10) either air or water but in this illustration, outside air.

FIG. 7B is an air to air heat pump system for a heating hook up, whereby the valves on the hatched lines are closed thereby providing a system in which heat at levels too low for heating is absorbed by the evaporator (9) (outside surface) pumped by the refrigeration mechanism to a condensing medium (outside surface) (10) either air or water but in this illustration, inside warm air. Chamber 18 has a piston that adjusts the cavity of the chamber.

FIG. 7C is a water to water heat pump system for a cooling hook up whereby air to be cooled is passed over coils in which cooled water is circulated. The condenser water (C.W.) from an outside source is channeled to the drain and rejected. 18 is a chamber having a piston.

FIG. 7D is a water to water heat pump system for a heating hook up whereby air to be warmed is passed over pipe coils in which warm condenser water is recirculated. The water from the heat source is channeled to the drain and rejected after passing through the water cooler. 18 is the chamber having a piston.

In larger plants the air is purified, cooled or heated, humidified or dried, according to the need, by the air conditioning plant and circulated through the building by means of ducts, as follows:

(1) air enters a section where it mixes with re-cycled air from the building (2) mixed air passes through a filtering section (not shown) (3) air temperature is controlled by passing the air through two tube banks in which one is of hot water or steam (not shown) and the other is a refrigerant.

A temperature sensor is usually located inside the room and connected to the plant and set to the desired temperature setting whereby the difference between the temperature needed and the actual temperature automatically determines which of the two tube banks is to be used.

In larger buildings the plant may supply air at a fixed temperature and local duct heaters in different rooms or building zones provide final temperature control in each room or zone; or one duct carries warm air while another carries cold air and whereby both are mixed at a given point for desired temperature or whereby the supply volume of air is controlled automatically by piston 208 and circuitry of FIGS. 5, 6 to any room or zone. Such larger plants may be visualized as follows: (1) fresh air intake (2) filtering system (3) cooling unit (as described in FIGS. 1–6 with the cooling tubes contained within the unit so as to cool the air passing them) (4) heating unit (with the heating tubes contained on line within the unit so as to heat the air passing them) (5) odor filter (of activated carbon for absorbing odors) (6) water spray humidifier (7) fan (8) diffuser (the hot and/or cold air is delivered into the room through slots or grilles in the walls close to the ceiling or within the ceiling (9) exhaust duct.

The principles of the present invention may also be applied to the heating unit whereby temperature may be controlled by controlling pressure, as follows:

In a closed system such as described previously for air conditioning and refrigeration systems (see FIGS. 1, 1A, 3, 5, 6) and cooling/heating heat pump systems (described in FIGS. 7A–D) the heating/cooling medium recirculates. Similarly with heating systems the heating medium recirculates steam heating, for example, chamber 18 containing a piston as described in FIG. 1A or a metal strip as described in FIG. 1 (or both) may be located in the steam riser pipe(s) whereby more or less of the heating medium may be drawn off. (The chamber described in FIG. 1 may also be connected to the return.) When a higher temperature is desired the piston or metal strip is made to close whereby pressure in the system is increased and more heat is created in the system thereby. Both the heat pump systems (described in FIGS. 7A–D) and any other closed system heating may operate manually (see FIGS. 1, 1A) semi automatically (as described in FIGS. 2–4) or automatically (as described in FIGS. 5, 6).

The closed systems for heating wherein the present invention may be applied with varying degrees of success are: Steam Heating hookups: (a) vapor heating systems (b) vacuum heating systems. Chamber 18 would be hooked up to the heat supply pipe(s) conditioners and refrigerators would require low start up amperage and compressors would no longer require starting windings because of the operations described in FIGS. 3, 6. Also the temperatures would not vary greatly in heating or cooling systems from shut down to start up of the system as the system may be made to be always "on" unless manually shut off hence providing for savings in fuel and repair and replacement costs.

It is a further objective of this application to show how the current to the compressor motor is controlled precisely, the control being correlated to the ambient temperature of the area to be conditioned. Hence, the 60 degree e.g. setting of FIGS. 1, 2, 3, 5 and a manual setting of 60 degrees in FIG. 4 controlling the current input to the compressor motor of the refrigeration circuit such that said current input is calibrated for most efficient output for 60 degrees e.g. and said output is maintained.

Plug 1 is plugged into an ac power supply, in FIG. 8. Switch 427 opens or closes the circuit. The compressor motor of FIGS. 1, 2, 3, 4, 5, 6, is plugged into any of the outlets 413–415, meter 420 shows the output to said connected motor(s). The three different coils extend to three different outlets, with three different current ratings. Coil 404 extends to outlet 415 which has an amperage output of 5 amperes e.g. coil 405 extends to outlet 415 which has an amperage output of 10 amperes and coil 461 extends to outlet 413 which has an amperage output of 1 ampere e.g. The three outlets 413, 415, 414 are served respectively by switches 413A, 415A and 461A, either enable independent operation and control of the current passing to the separate outlets, or enable jointly the operations and controls of the current passing to the concurrent outlets. When the switches are closed, the current passes jointly to all three of said outlets. When one switch is closed and the others opened only the current to the outlet having the closed switch is controlled. Gear 419 controls the elevation of metal bar B thereby controlling the size of the gap of a reactor means having a magnetic core C, such that when bar B is elevated the gap is increased, thereby allowing more current to the outlets. Lowering the bar over core C decreases the gap thereby decreasing said current to said outlets and to the connected refrigeration circuit, in a calibrated relationship to the increase or decrease of refrigerant to the said circuit. Gear 419 is geared to 12—12 having gearing means (not shown) in FIGS. 1, 1A or geared to the gear of motor 111 in FIGS. 2, 3, or geared to motor 207 in FIG. 5 or to 303 and/or 310 in FIG. 6. Thus a calibrated relationship may be made and said relationship controlled whereby the current of the compressor motor is proportionately controlled in relationship to the pressure requirements of said refrigeration circuit in producing an ambient temperature equal to a selected temperature setting, with said current being controlled in a direct proportional relationship to the amount of refrigerant in a refrigeration circuit to attain a selected temperature, while current and refrigerant pressure being controlled in inverse proportional relationship to temperature of said area. Diode 11 via filter capacitor 17 changing AC to DC going to meter 420.

FIG. 9 is a drawing of circuit breaking means functioning to make or break the circuit having a plurality of refrigeration circuits connected to the circuit breaking means upon a current beyond the one correlated to produce said ambient temperature of a given area correlated to the amount of refrigerant in the refrigeration circuit as explained in the disclosure concerning FIG. 8. Should there be a current overload, current to one or more refrigeration circuits is cut off automatically with current reinstated automatically to said circuits upon a stabilization within the controlled relationship as described in FIG. 8.

In FIG. 9 all the identically numbered parts as in FIG. 8 operate as disclosed in FIG. 8. The following additional parts provide circuit breaking means. The voltage applied to coil 529 a maximum output of 10 volts e.g. activates relay 522 thereby drawing in relay bar 523, thereby opening switch 525 enabling the opening of the main circuit that extends down to plug 401. The opening of the main circuit will not take place until there is an increase of more than 1 ampere e.g. above the current allotment to the compressor motor(s). Variable resistor 519 operating in conjunction with gear 419 functions as follows: When bar B is fully raised over the gap of core C whereby maximum current is fed to compressor motor(s) relay 522 is set to its lowest sensitivity thereby requiring a large current change to induce a high enough voltage across coil 529 in order to activate relay 522 whereby drawing in relay bar 523. When bar B is lowered over gap of core C whereby fully covering it, relay 522 is set to its highest sensitivity. At this point resistor 519 is set to maximum whereas when bar b was fully raised over core C, 519 was set to minimum. Thus gear 419 being geared to 12 (or 13) in FIGS. 1, 1A, gear of motor 111 in FIGS. 2–4, gear of motor 207 in FIG. 5, gear 303 to 310 in FIG. 6 operating in conjunction with variable resistor 519 functioning to trip relay 522 upon a short or overload above said allotment to break the circuit. Contacts 525 and 526 are partially magnetized to resist rumble and to close the relay contact, thereby stabilizing the current passing through these contacts. The two magnetic contacts 526 when tripped hold the main circuit open. To turn current back to on, switch 523 is manually turned to on, after the defective device has been disconnected. When magnetic contacts 526 are removed the relay 522 will reset itself automatically when the defective load is removed. Capacitors 521, 524 and 571 function as follows: filter capacitor 521 purifies DC for stable operation of relay 522; 524 reduces the sparking of contacts 525,526 when opening and closing the main power switch; 271 stabilizes meter 120 of DC ripple. Hinge H in FIGS. 8, 9, is used as an aid in moving bar B.

FIG. 10 illustrates how a supply volume of heated or cooled air is calibrated by the size of the cavity of chamber 905 so as to effect continuously and automatically a temperature of a given area calibrated in a relationship to the supply volume, such that the actual temperature of said area is continuously equal to a selected temperature setting for the area. (The selected setting of the selected temperature is effected by 225 on meter 380 of FIG. 6.) Input duct 901 feeds conditioned air into chamber 905 from an air conditioning system. More or less of said conditioned air is fed to said area via output duct 902. The supply volume is adjusted by piston 903. The piston is controlled by the means disclosed in FIG. 6, such that when 919 is geared to 303 in FIG. 6 thereby providing automatic control of a calibrated supply whereby adjusting the temperature continuously up or down in accordance with the changes in the actual temperature changes of said area whereby the actual temperature is continuously equal to a selected temperature setting for said area. It should be noted that gear 906 and 907 may be placed on screw means 904 instead of 919 whereby enabling a calibrated supply volume for larger or smaller areas. Gear 919 being geared to 310 thereby enabling manual and/or automatic control of supply volume to the area. It should be noted that motor 207 in FIG. 5 and motor 304 in FIG. 6 control also faucet 17 of FIG. 1 and piston 18 when faucet 17 and piston 18 is geared to motor 207 in FIG. 5; also when 17 and 18 are geared to motor 304 in FIG. 6. Hence 307 in FIG. 6 may control faucet 17 and piston 18.

Note also that motor 304 and gear 303 are provided with means that enable the disconnection of gear 303 and motor 304 from gear 305 thus providing manual and/or automatic operation of FIGS. 5, 6. Manual and automatic operation is provided when motor 304 is geared to 305 via gear 303 as shown in FIG. 6. The manual adjustment is provided by 310 performing the same function as 13 in FIG. 1. Manual or automatic operation is provided as disclosed in the disclosure of FIG. 6; also, it is provided when 304 and 303 are disconnected from 305 at the option of the user. Motor 304 and gear 303 may be mounted on a radial slide (not shown) or other appropiate guides or slides enabling 303 to mesh with gear 305 when automatic operation as described in FIG. 6 is desired. 303 may be placed in the position whereby gear 303 no longer meshes with gear 305 for manual operation. The manual and automatic operation combination is described in FIG. 6. See the disclosure describing the operation of manual adjustment 310.

Also, it should be clarified that 13 and 17 in FIG. 1 may control the size of the orifice of a system wherein refrigerant under high pressure may enter chamber 18 and refrigerant under low pressure enters chamber 18. The high and low pressure refrigerant is mixed. The orifice controlling the mixture is varied and regulated by one or more contracting and expanding means and piston means. Note that controlling the orifice via expanding and contracting means and piston means may apply when FIGS. 1, 1A is connected to a heating system wherein a heating medium, such as steam under high pressure and steam under low pressure is mixed in chamber 18.

Hence, FIGS. 1-4 may be used in conjunction with FIGS. 5, 6, thereby providing an apparatus with manual and/or automatic control means. Duct 901 feeds cold air to a chamber 905 while duct 908 feeds hot air to chamber 905. The amount of cold air is controlled by valve 909. The amount of hot air is controlled by valve 910.

Figure 11:
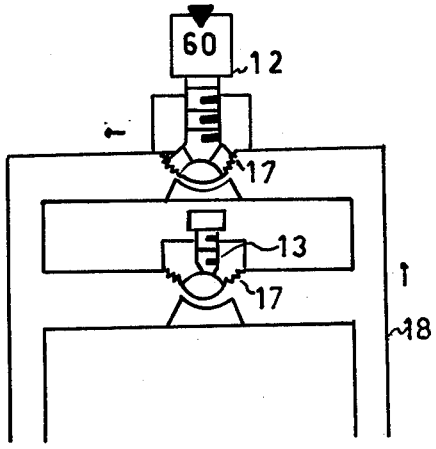
FIG. 11 is a drawing of the faucet type thermostat controlling a closed heating circuit.
Figure 11B:
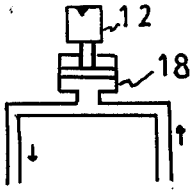
FIG. 11B is a drawing showing the drawing off of a high pressure heating medium from a closed heating circuit and the control of temperature thereby.
Figure 11A:
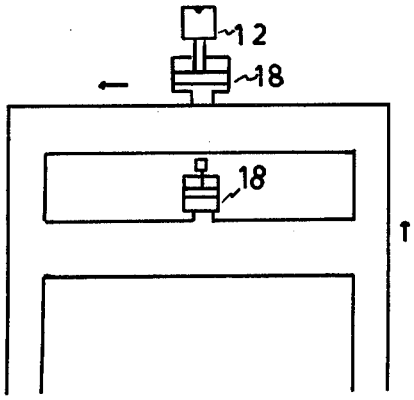

FIG. 11 is a drawing illustrating the operations applying to heating systems disclosed previously. As in FIG. 1A components 12 and 17 perform the functions previously explained in the disclosure of FIG. 1A. The pipe with the arrow pointing upwards carries a high pressure heating medium (such as steam rising in the steam risers or steam main) and connecting it to a pipe carrying a low pressure heating medium (such as the return main above the water level), indicated by the arrow pointing in a downward direction. The mixing pipe for mixing the high pressure and low pressure medium is controlled by 12 and 17. 12, having gearing means (not shown) may be geared to 303 (in FIG. 6) at the option of the user thereby providing automatic control of temperature. This is in keeping with the functions disclosed for FIG. 6 describing the automatic control of pressure. FIGS. 11, 11A, 11B provides the means for controlling the size of the orifice of chamber 18 such that when 18 is connected to a closed heating circuit whereby a high pressure and low pressure medium is mixed (as shown in FIG. 11) or when a high pressure medium is drawn off (as shown in FIGS. 11A, 11B) by piston means the actual temperature of an area becomes equal to a selected temperature setting for the area. The pressure requirements of the heating circuit is controlled inversely proportional in accordance with changes in the actual temperature. The automatic means (of FIG. 6) determine whether the actual temperature is above or below the selected temperature. FIG. 6 illustrates the means operably connected to FIGS. 11—11B for controlling the size of the cavity and orifice of chamber 18 such that the pressure requirement is adjusted in an inverse proportional relationship to actual temperature changes for providing an immediate corrective increase or decrease in the pressure requirements in accordance with these changes and in accordance with changes in the selected temperature setting. The maintenance of the equal temperature is thereby provided without great variation.

Manual operation of FIGS. 11—11B is achieved when 12 is adjusted manually. Hence, FIG. 6 discloses the automatic and/or manual operations of FIGS. 11—11B.

What is claimed is:

1. A temperature control apparatus comprising, means for controlling a variable chamber such that said chamber controls refrigerant pressure of a refrigeration circuit in a relationship in accordance with the varying and regulating of a point temperature setting, means for enabling the compressor of said circuit to start up without a starting winding, scanning means for scanning temperature responsive means thereby determining whether or not said refrigerant pressure is to be increased or decreased such that said increase or decrease providing said temperature of an area that is equal to the point temperature of said temperature setting and wherein said refrigerant pressure is increased or decreased in accordance with said determination, controlled in said relationship in accordance with the varying and regulating of a point temperature of a temperature setting, a plurality of magnetic switching means, a first of said plurality of magnetic switching means activating and deactivating a first winding of a motor, a second of said plurality of magnetic switching means activating and deactivating a second winding of said motor, said activating and deactivating of said first winding is accomplished via a first relay, said activating and deactivating of said second winding is accomplished via a second relay, a third of said plurality of magnetic switching means controls said second winding via a third relay such that said third relay serves to decrease said refrigerant pressure upon a simultaneous activation of said first and said second winding, said magnetic switching means is controlled by a magnet moving in and out of the magnetic influence of said magnetic switching means such that said motor controlling said variable chamber is activated when said temperature is not equal to the point temperature of said temperature setting.

2. An apparatus of claim 1 wherein means is provided for increasing or decreasing the current to one or more refrigeration circuits in accordance with the said increase or decrease of said refrigerant pressure, and wherein means is provided for enabling one or more of said compressor motors of said refrigeration circuits to start up operation without a starting winding.

3. An apparatus of claim 1 comprising circuit breaking means for breaking the circuit of said compressor of said one or more refrigeration circuits connected to a power supply upon a predetermined increase beyond the said current input to said compressor of said one or more refrigeration circuits operating in a relationship to the point temperature of a temperature setting, means providing wherein said broken circuit is reset automatically to said power supply upon correction of said current to said compressor of one or more refrigeration circuits operating in said relationship to the said point temperature setting when said predetermined current beyond said relationship has been alleviated.

4. An apparatus of claim 1 said apparatus comprising a water to water heat pump system.

5. An apparatus of claim 1 comprising at least one reactor means having a magnetic core with at least one air gap, first wiring means for connection of said reactor means to said compressor of said one or more refrigeration circuits, second wiring means for connecting said reactor means to a power supply, means for varying and regulating said gap in accordance with the varying and regulating of a point temperature of said temperature setting.

6. A temperature control apparatus comprising, means for controlling a variable chamber such that said chamber controls refrigerant pressure of a refrigeration circuit, means for varying and regulating a quantity of said refrigerant under high pressure with a quantity of refrigerant under low pressure thereby providing a resulting refrigerant pressure, said resulting refrigerant pressure is regulated and varied in a relationship in accordance with the varying and regulating of a point temperature setting, means for enabling the compressor of said circuit to start up without a starting winding, scanning means for scanning temperature responsive means thereby determining whether or not said refrigerant pressure is to be increased or decreased such that said increase or decrease provides said temperature of an area that is equal to the point temperature of said temperature setting and wherein said refrigerant pressure is increased or decreased in accordance with said determination, controlled in said relationship in accordance with the varying and regulating of a point temperature of a temperature setting, a plurality of magnetic switching means, a first of said plurality of magnetic switching means activating and deactivating a first winding of a motor, a second of said plurality of magnetic switching means activating and deactivating a second winding of said motor, said activating and deactivating of said first winding is accomplished via a first relay, said activating and deactivating of said second winding is accomplished via a second relay, a third of said plurality of magnetic switching means controls said second winding via a third relay such that said third relay serves to decrease said refrigerant pressure upon a simultaneous activation of said first and said second winding, said magnetic switching means is controlled by a magnet moving in and out of the magnetic influence of said magnetic switching means such that said motor controlling said variable chamber is activated when said temperature is not equal to the point temperature of said temperature setting.

7. An apparatus of claim 6 wherein means is provided for increasing or decreasing the current to one or more refrigeration circuits in accordance with the said increase or decrease of said refrigerant pressure, and wherein means is provided for enabling one or more of said compressor motors of said refrigeration circuits to start up operation without a starting winding.

8. An apparatus of claim 6 comprising circuit breaking means for breaking the circuit of said compressor of said one or more refrigeration circuits connected to a power supply upon a predetermined increase beyond the said current input to said compressor of said one or more refrigeration circuits operating in a relationship to the point temperature of a temperature setting, means providing wherein said broken circuit is reset automatically to said power supply upon correction of said current to said compressor of one or more refrigeration circuits operating in said relationship to the said point temperature setting when said predetermined current beyond said relationship had been alleviated.

9. An apparatus of claim 6 said apparatus comprising a water to water heat pump system.

10. An apparatus of claim 6 comprising at least one reactor means having a magnetic core with at least on air gap, first wiring means for connection of said reactor means to said compressor of said one or more refrigeration circuits, second wiring means for connecting said reactor means to a power supply, means for varying and regulating said gap in accordance with the varying and regulating of a point temperature of said temperature setting.

11. An apparatus for simultaneously controlling refrigerant pressure of a refrigeration circuit and controlling current input to a compressor of one or more refrigeration circuits in a relationship to a point temperature of a temperature setting, said control providing: enabling said compressor to start up without a starting winding, enabling said compressor of said plurality of refrigeration circuits to be controlled by a single circuit breaker, enabling the circuit connecting said compressor of said one or more of said refrigeration circuits to a power supply to be broken upon a predetermined current increase beyond said relationship to said point temperature of said temperature setting, enabling the automatic resetting of said circuit to said power supply when said predetermined current increase beyond said current controlled in said relationship to said point temperature of a temperature setting has been alleviated, enabling said compressor to be maintained running after the temperature of an area conditioned by said compressor of one or more of said refrigeration circuits becomes equal to a temperature of a temperature setting, said apparatus comprising, means for controlling a variable chamber, means for controlling the current input to said compressor of said one or more refrigeration circuits, circuit breaking means connected to said means for controlling said current, for breaking the circuit to said compressor of said one or more refrigeration circuits connected to said power supply, means for said resetting of said circuit to said power supply when said predetermined current increase beyond said current controlled in said relationship has been alleviated.

12. An apparatus of claim 11 comprising scanning means for scanning temperature responsive means thereby determining whether or not said refrigerant pressure and said current input is to be increased or decreased such that said increase or decrease provides said temperature of an area that is equal to the point temperature of a temperature setting.

13. An apparatus of claim 11 comprising a plurality of magnetic switching means activating and deactivating a first winding of a motor, a second of said plurality of magnetic switching means activating and deactivating a second winding of said motor, said activating and deactivating of said first winding is accomplished via a first relay, said activating and deactivating of said second winding is accomplished via a second relay, a third of said plurality of magnetic switching means controls said second wind via a third relay such that said third relay serves to decrease said refrigerant pressure upon a simultaneous activation of said first and said second winding, said magnetic switching means is controlled by a magnet moving in and out of the magnetic influence of said magnetic switching means such that said motor controlling said variable chamber and said current input is activated when said temperature is not equal to the point of said temperature setting.

14. An apparatus of claim 11 comprising at least one reactor means having a magnetic core with at least one air gap, first wiring means for connection of said reactor means to said compressor of said one or more refrigeration circuits, second wiring means for connecting said reactor means to a power supply, and means for varying and regulating said gap in accordance with the varying and regulating of a point temperature of said temperature setting.

15. An apparatus of claim 11, wherein said apparatus is controlled manually and automatically.

16. An apparatus of claim 11 wherein means is provided for varying and regulating the orifice of said chamber.

17. An apparatus of claim 11 comprising a water to water heat pump system.

18. An apparatus of claim 11, wherein said apparatus is controlled automatically.

19. An apparatus of claim 11, wherein said means for controlling a variable chamber and said means for controlling the said current input is varied and regulated manually.

20. An apparatus for simultaneously and independently controlling refrigerant pressure of a refrigeration circuit and simultaneously and independtly controlling current input to a compressor of one or more refrigeration circuits in a relationship to a point temperature of a temperature setting, said simultaneous and independent control of said refrigerant pressure and said current input providing: enabling said compressor to start up without a starting winding, enabling said compressor of said plurality of refrigeration circuits to be controlled by a single circuit breaker, said simultaneous control and said independent control of said current input, enabling the circuit connecting said compressor of said one or more of said refrigeration circuits to a power supply to be broken upon a predetermined current increase beyond said relationship to said point temperature of a temperature setting, enabling the automatic resetting of said circuit to said power supply when said predetermined current increase beyond said current controlled in said relationship to said point temperature of a temperature setting has been alleviated, said simultaneous and independent control of said refrigerant pressure and said current input enabling said compressor to be maintained running after the temperature of an area conditioned by said compressor of one or more of said refrigeration circuits becomes equal to a temperature of a temperature setting, said apparatus comprising, means for controlling a variable chamber, means for controlling the current input to said compressor of said one or more refrigeration circuits, circuit breaking means connected to said means for controlling said current for breaking the circuit to said compressor of said one or more refrigeration circuits connected to said power supply, means for said resetting of said circuit to said power supply when said predetermined current increase beyond said current controlled in said relationship has been alleviated.

21. An apparatus of claim 20 comprising scanning means for scanning temperature responsive means thereby determining whether or not said refrigerant pressure and said current input is to be increased or decreased such that said increase or decrease provides said temperature of an area that is equal to the point temperature of a temperature setting.

22. An apparatus of claim 21 comprising a plurality of magnetic switching means activating and deactivating a first winding of a motor, a second of said plurality of magnetic switching means activating and deactivating a second winding of said motor, said activating and deactivating of said first winding is accomplished via a first relay, said activating and deactivating of said second winding is accomplished via a second relay, a third of said plurality of magnetic switching means controls said second winding via a third relay such that said third relay serves to decrease said refrigerant pressure upon a simultaneous activation of said first and said second winding, said magnetic switching means is controlled by a magnet moving in and out of the magnetic influence of said magnetic switching means such that said motor controlling said variable chamber and said current input is activated when said temperature is not equal to the point of said temperature setting.

23. An apparatus of claim 20 comprising at least one reactor means having a magnetic core with at least one air gap, first wiring means for connection of said reactor means to said compressor of said one or more refrigeration circuits, second wiring means for connecting said reactor means to a power supply, and means for varying and regulating said gap in accordance with the varying and regulating of a point temperature of said temperature setting.

24. An apparatus of claim 20, wherein said apparatus is controlled manually and automatically.

25. An apparatus of claim 20 wherein means is provided for varying and regulating the orifice of said chamber.

26. An apparatus of claim 20 comprising a water to water heat pump system.

27. An apparatus of claim 20, wherein said apparatus is controlled automatically.

28. An apparatus of claim 20, wherein said means for controlling a variable chamber and said means for controlling the said current input is varied and regulated manually.

29. A method for simultaneously controlling refrigerant pressure of a refrigeration circuit and controlling current input to a compressor of one or more refrigeration circuits in a relationship to a point temperature of a temperature setting, said control providing: enabling said compressor to start up without a starting winding, enabling said compressor of said plurality of refrigeration circuits to be controlled by a single circuit breaker, enabling the circuit connecting said compressor of said one or more of said refrigeration circuits to a power supply to be broken upon a predetermined current increase beyond said relationship to said point temperature of said temperature setting, enabling the automatic resetting of said circuit to said power supply when said predetermined current increase beyond said current controlled in said relationship to said point temperature of a temperature setting has been alleviated, enabling said compressor to be maintained running after the temperature of an area being conditioned by said compressor of one or more of said refrigeration circuits becomes equal to a temperature of a temperature setting, by controlling a temperature control apparatus comprising, means for controlling a variable chamber, means for controlling the current input to said compressor of said one or more refrigeration circuits, circuit breaking means connected to said means for controlling said current, for breaking the circuit to said compressor of said one or more refrigeration circuits connected to said power supply, means for said resetting of said circuit to said power supply when said predetermined current increase beyond said current controlled in said relationship has been alleviated, the steps comprising, controlling simultaneously said means for controlling said chamber and said means for controlling said current input such that said simultaneous controlling provides said controlling of said refrigerant pressure and said current input to said compressor of said one or more of said refrigeration circuits in said relationship to a point temperature of a temperature setting during said compressor start up thereby providing said start up without said starting winding, controlling said circuit breaking means during said predetermined current increase beyond said relationship to said point temperature of a temperature setting such that said circuit breaking means breaks said circuit to said power supply by controlling said current control means, controlling said resetting means such that said circuit is reset automatically to said power supply when said predetermined current increase beyond said relationship to said point temperature of a temperature has been alleviated, by controlling said circuit breaking means, controlling simultaneously said means for controlling said chamber and said means for controlling said current input during the operation of said compressor of said one or more refrigeration circuits such that said simultaneous controlling providing said controlling of said refrigerant pressure and said current input to said compressor of said one or more of said refrigeration circuits in said relationship to a point temperature of a temperature setting during said operation thereby providing said compressor of said one or more refrigeration circuits to be maintained running after the temperature of an area being conditioned by said compressor of said one or more of said refrigeration circuits becomes equal to a temperature of a temperature setting.

30. A method for simultaneously and independently controlling refrigerant pressure of a refrigeration circuit and simultaneously and independently controlling current input to a compressor of one or more refrigeration circuits in a relationship to a point temperature of a temperature setting, said simultaneous and independent control of said refrigerant pressure and said current input providing: enabling said compressor to start up without a starting winding, enabling said compressor of said plurality of refrigeration circuits to be controlled by a single circuit breaker, said simultaneous control and said independent control of said current input, enabling the circuit connecting said compressor of said one or more of said refrigeration circuits to a power supply to be broken upon a predetermined current increase beyond said relationship to said point temperature of a temperature setting, enabling the automatic resetting of said circuit to said power supply when said predetermined current increase beyond said current controlled in said relationship to said point temperature of a temperature setting has been alleviated, said simultaneous and independent control of said refrigerant pressure and said current input enabling said compressor to be maintained running after the temperature of an area conditioned by said compressor of one or more of said refrigeration circuits becomes equal to a temperature of a temperature setting, by controlling a temperature control apparatus comprising, means for controlling a variable chamber, means for controlling the current input to said compressor of said one or more refrigeration circuits, circuit breaking means connected to said means for controlling said current, for breaking the circuit to said compressor of said one or more refrigeration circuits connected to said power supply, means for said resetting of said circuit to said power supply when said predetermined current increase beyond said current controlled in said relationship has been alleviated, the steps comprising, controlling simultaneously, when said simultaneous control is desired, controlling independently when said independent control is desired, said means for controlling said chamber and said means for controlling said current input such that said simultaneous and independent control provides, said controlling simultaneously and independently of said refrigerant pressure and said current input to said compressor of one or more of said refrigeration circuits in said relationship to a point temperature of a temperature setting during said compressor start up thereby providing said start up without said starting winding, controlling said circuit breaking means during said predetermined current increase beyond said relationship to said point temperature of a temperature setting such that said circuit breaking means breaks said circuit to said power supply by said controlling of said current control means, controlling said resetting means such that said circuit is reset automatically to said power supply when said predetermined current increase beyond said relationship to said point temperature of a temperature has been alleviated, by said controlling of said circuit breaking means, controlling simultaneously, when said simultaneous controlling is desired, controlling independently, when said independent control is desired, said means for controlling said chamber and said means for controlling said current input during the operation of said one or more refrigeration circuits such that said simultaneous and independent controlling provides said controlling of said refrigerant pressure and said current input to said compressor of said one or more refrigeration circuits in said relationship to a point temperature of a temperature setting thereby providing said compressor of said one or more refrigeration circuits to be maintained running after the temperature of an area being conditioned by said compressor of said one or more of said refrigeration circuits becomes equal to a temperature of a temperature setting.

* * * * *